US009490580B2

(12) United States Patent
Lan et al.

(10) Patent No.: US 9,490,580 B2
(45) Date of Patent: Nov. 8, 2016

(54) RECEPTACLE CONNECTOR

(71) Applicant: Cheng Uei Precision Industry Co., Ltd., New Taipei (TW)

(72) Inventors: Rong-Qin Lan, Dong-Guan (CN); Yin-Lung Wu, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/517,782

(22) Filed: Oct. 17, 2014

(65) Prior Publication Data

US 2016/0111821 A1 Apr. 21, 2016

(51) Int. Cl.

| | |
|---|---|
| ***H01R 13/648*** | (2006.01) |
| ***H01R 13/646*** | (2011.01) |
| ***H01R 24/76*** | (2011.01) |
| ***H01R 13/6585*** | (2011.01) |
| *H01R 12/72* | (2011.01) |

(52) U.S. Cl.

CPC ..... *H01R 13/646* (2013.01); *H01R 13/6585* (2013.01); *H01R 24/76* (2013.01); *H01R 12/724* (2013.01)

(58) Field of Classification Search

CPC ..... H01R 13/646; H01R 24/76

USPC ..... 439/607.01–607.14, 607.27–607.58, 439/608, 620.1, 620.19, 497

See application file for complete search history.

(56) References Cited

U.S. PATENT DOCUMENTS

| | | | | |
|---|---|---|---|---|
| 4,449,778 | A * | 5/1984 | Lane | H01R 13/65802 439/293 |
| 4,508,415 | A * | 4/1985 | Bunnell | H01R 9/032 439/497 |
| 4,781,623 | A * | 11/1988 | Philippson | H01R 13/65802 439/670 |
| 6,065,993 | A * | 5/2000 | Lai | H01R 13/6593 439/402 |
| 6,171,134 | B1 * | 1/2001 | Lai | H01R 12/675 439/405 |
| 6,254,411 | B1 * | 7/2001 | Chapman | H01R 29/00 439/189 |
| 8,740,649 | B2 * | 6/2014 | Lan | H01R 13/506 439/607.4 |
| 8,851,927 | B2 * | 10/2014 | Hsu | H01R 13/6594 439/607.11 |
| 9,022,800 | B2 * | 5/2015 | Yang | H01R 13/6581 439/487 |
| 2014/0364006 | A1 * | 12/2014 | Lo | H01R 13/6461 439/607.01 |

* cited by examiner

*Primary Examiner* — Amy Cohen Johnson
*Assistant Examiner* — Milagros Jeancharles
(74) *Attorney, Agent, or Firm* — Cheng-Ju Chiang

(57) ABSTRACT

A receptacle connector includes a first terminal assembly, a second terminal assembly mounted on the first terminal assembly with front parts of second terminals being located over front parts of first terminals, a tongue board assembly mounted between the first terminal assembly and the second terminal assembly, and an insulating housing molded outside the first terminal assembly, the second terminal assembly and the tongue board assembly. The tongue board assembly includes an insulating body positioning the front parts of the first terminals and the second terminals in bottom and top faces thereof. Front ends of the first terminals and the second terminals are exposed outside top and bottom faces of a tongue board of the insulating housing, wherein the tongue board together with the front ends of the first terminals and the second terminals are about a horizontal center plane of the tongue board.

10 Claims, 13 Drawing Sheets

RECEPTACLE CONNECTOR

BACKGROUND OF THE INVENTION

1. Field of the Invention

The present invention relates to a connector, and more particularly to a receptacle connector.

2. The Related Art

Nowadays, receptacle connectors are widely used in electronic products to realize signal transmission between the electronic products and corresponding peripheral equipments thereof. In order to meet market requirements, the receptacle connectors are being at the period of mass production. With the rapid development of electronic technology, the receptacle connector is required to give consideration to both high speed information transmission rate and miniaturization structure.

However, the receptacle connector is often mated with a mating connector in a single direction for insertion. As a result, users need to recognize positive and negative directions of the receptacle connector firstly before using the electronic product. It is inconvenient for the users. Furthermore, inventor usually increases the quantity of terminals in order to improve the transmission rate of the receptacle connector. But it brings about more interference signals among the terminals. As a result, the inventor needs to design a shielding element to resolve the interference signals. So a receptacle connector capable of overcoming the foregoing problems is required.

SUMMARY OF THE INVENTION

Accordingly, an object of the present invention is to provide a receptacle connector. The receptacle connector includes a first terminal assembly, a second terminal assembly, a tongue board assembly, an insulating housing and a shielding shell. The first terminal assembly includes a first housing and a plurality of first terminals integrated with the first housing. The first terminals are arranged in horizontal transverse direction in front of the first housing and are arranged in vertical front and rear rows under the first housing. The second terminal assembly includes a second housing and a plurality of second terminals integrated with the second housing. A rear of a bottom face of the second housing protrudes downward to form an extending portion. The second terminals are arranged in horizontal transverse direction in front of the second housing and are arranged in horizontal transverse direction under the extending portion. The second terminal assembly is mounted downward onto the first terminal assembly, wherein the second housing is fastened upon the first housing, the extending portion is positioned in rear of the first housing, and the second terminals are located over and behind the first terminals. The tongue board assembly is mounted between the first terminal assembly and the second terminal assembly. The tongue board assembly includes an insulating body and a middle shielding sheet integrated with the insulating body. A rear of the middle shielding sheet is clamped between the first housing and the second housing. The insulating body is located in front of the first housing and the second housing to position the first terminals and the second terminals into a bottom face and a top face of the insulating body respectively. The insulating housing has a base portion molded outside the first housing, the rear of the middle shielding sheet and the second housing. A front face of the base portion protrudes frontward to form a tongue board molded outside the insulating body together with the first terminals and the second terminals. Front ends of the first terminals and the second terminals are respectively exposed outside top and bottom faces of the tongue board. Tail ends of the first terminals and the second terminals project beyond a bottom face of the base portion. The shielding shell is worn around the insulating housing.

As described above, the first terminal assembly, the second terminal assembly, the tongue board assembly and the insulating housing are molded together to form the receptacle connector, wherein the tongue board together with the front ends of the first terminals and the second terminals of the receptacle connector are symmetrical about a horizontal center plane of the tongue board. Therefore, users don't need to recognize positive and negative directions of the receptacle connector specially when using the receptacle connector. It is convenience for use and the structure is stable, even it improves the effect of the signal transmission.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
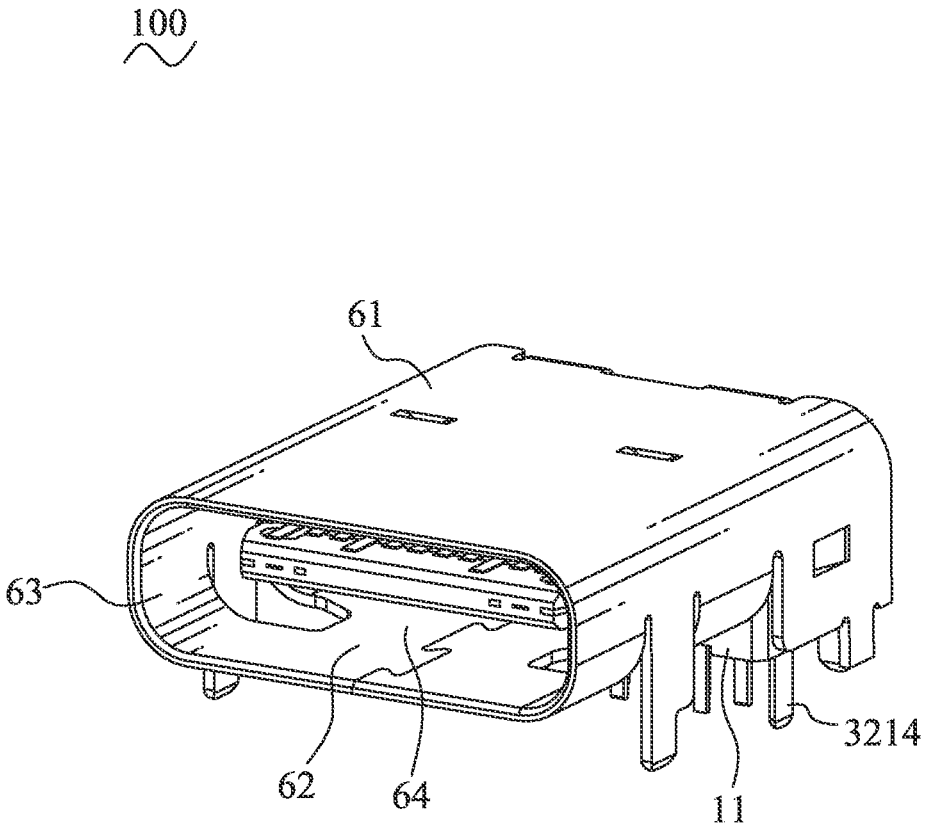
FIG. 1 is an assembled, perspective view of a receptacle connector in accordance with an embodiment of the present invention.
Figure 2:
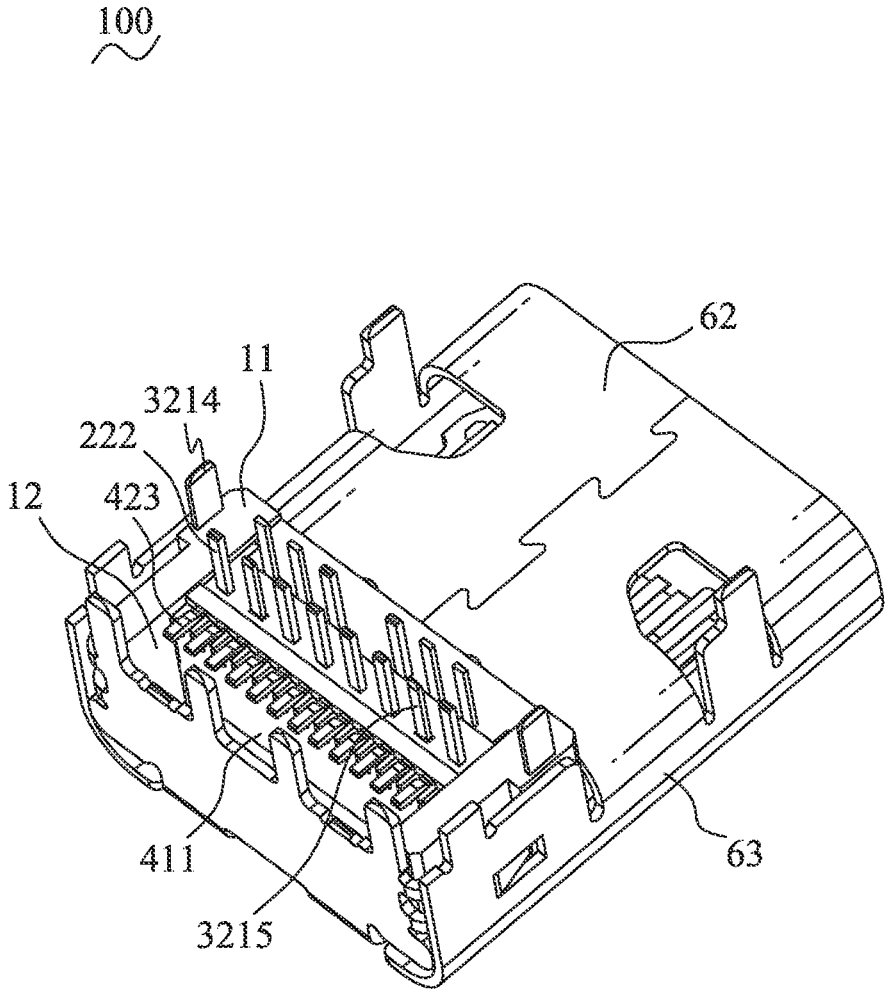
FIG. 2 is another assembled, perspective view of the receptacle connector shown in FIG. 1.
Figure 3:
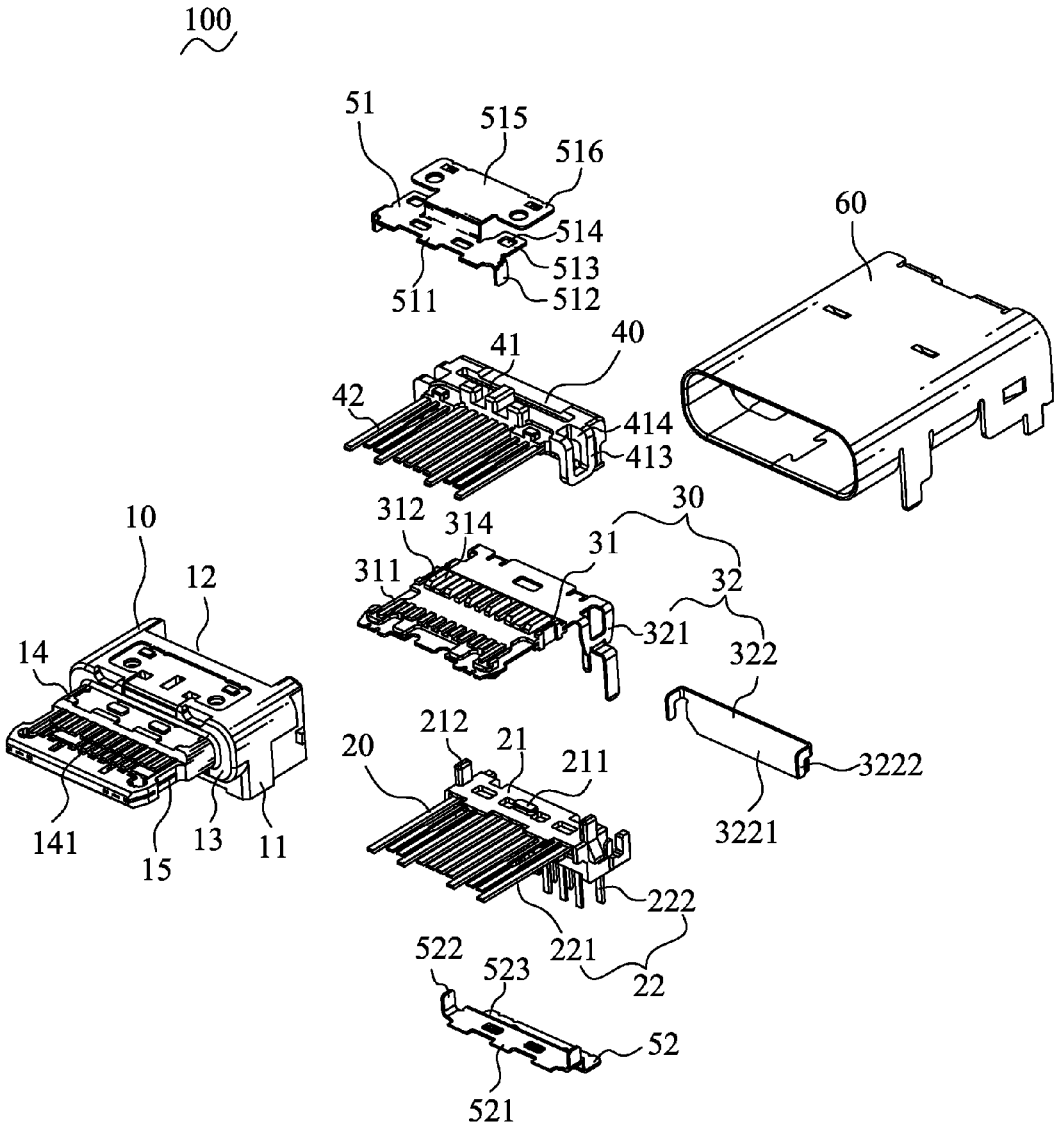
FIG. 3 is an exploded, perspective view of the receptacle connector shown in FIG. 1.
Figure 4:
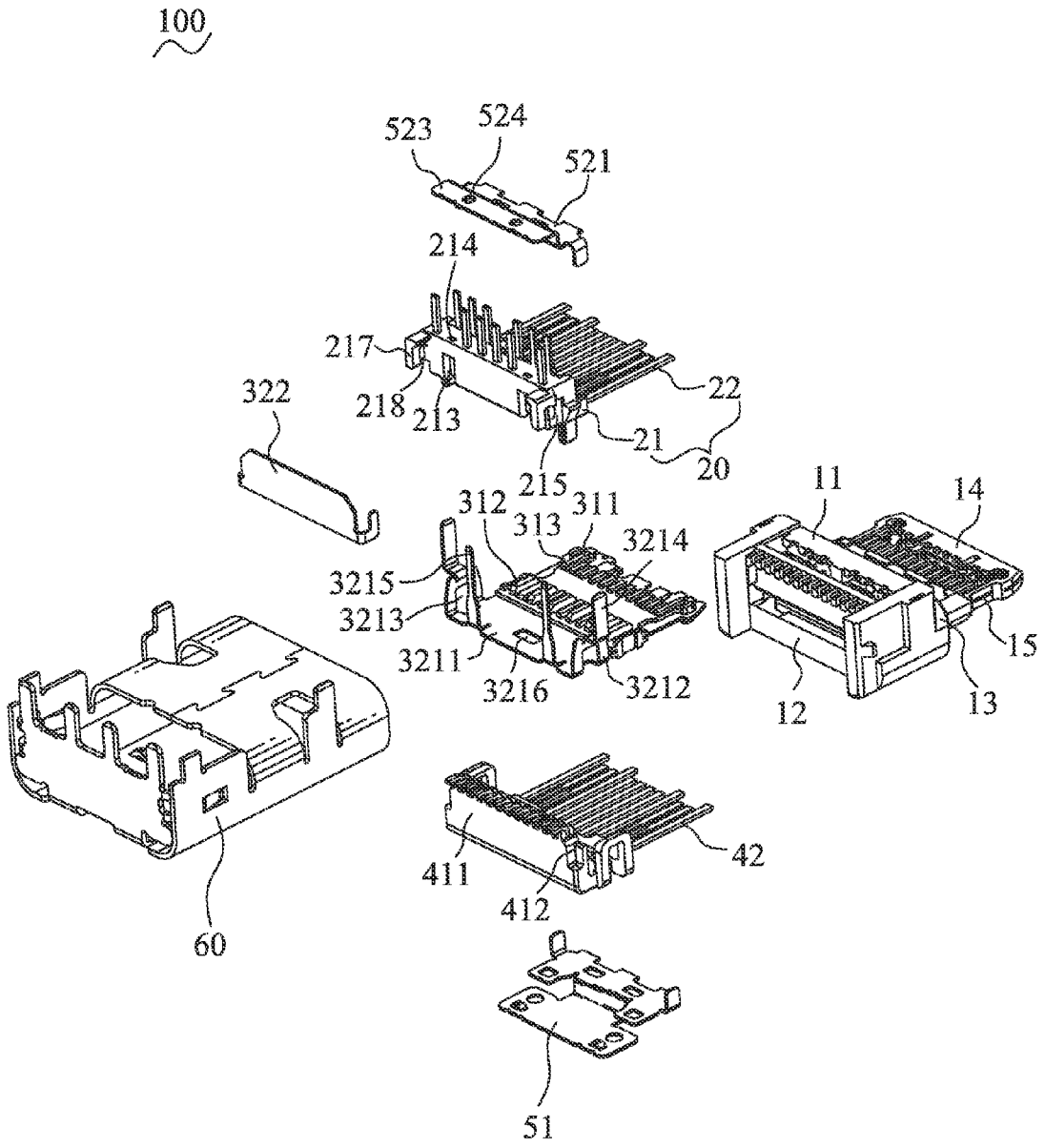
FIG. 4 is another exploded, perspective view of the receptacle connector shown in FIG. 1.
Figure 5:
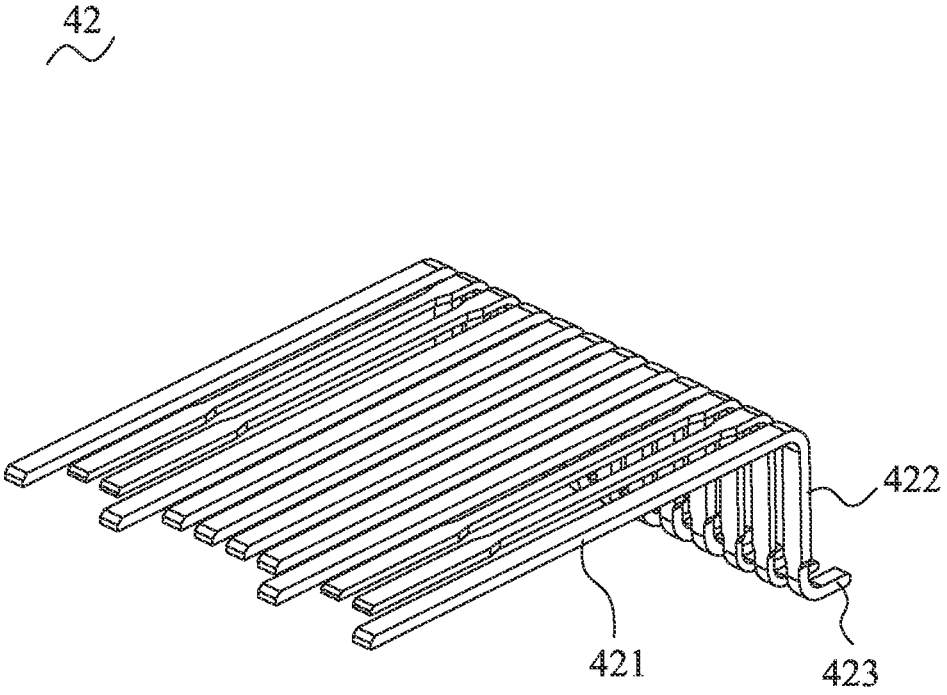
FIG. 5 is an exploded, perspective view of second terminals of the receptacle connector of FIG. 3.
Figure 6:
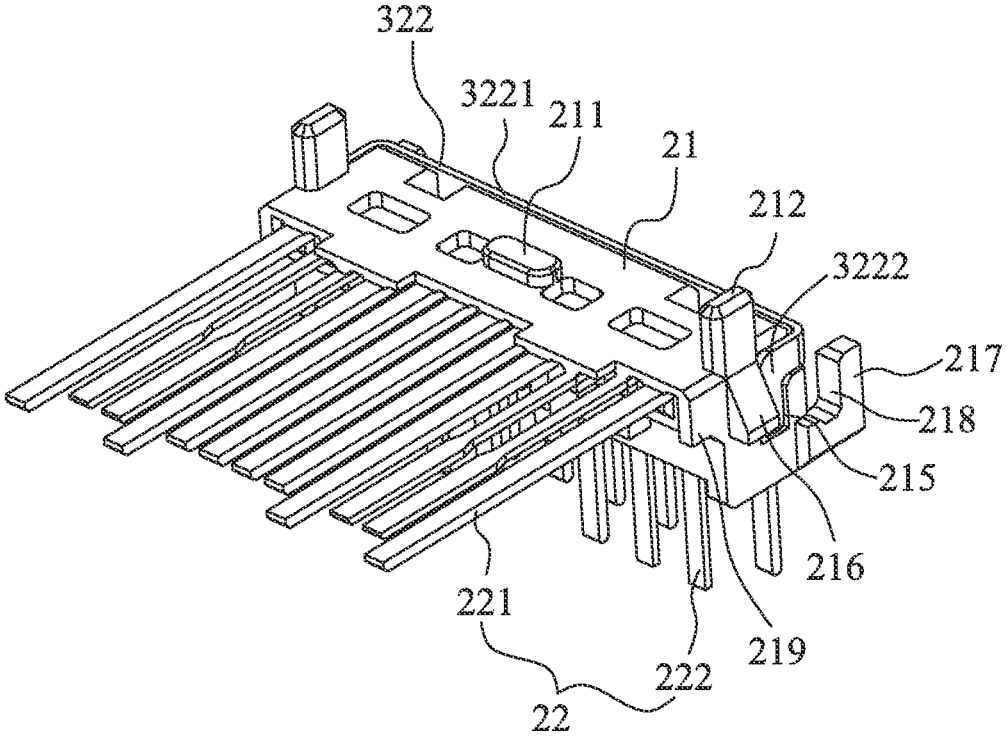
FIG. 6 is a perspective view showing that a cover sheet is assembled to a first terminal assembly of the receptacle connector of FIG. 3.
Figure 7:
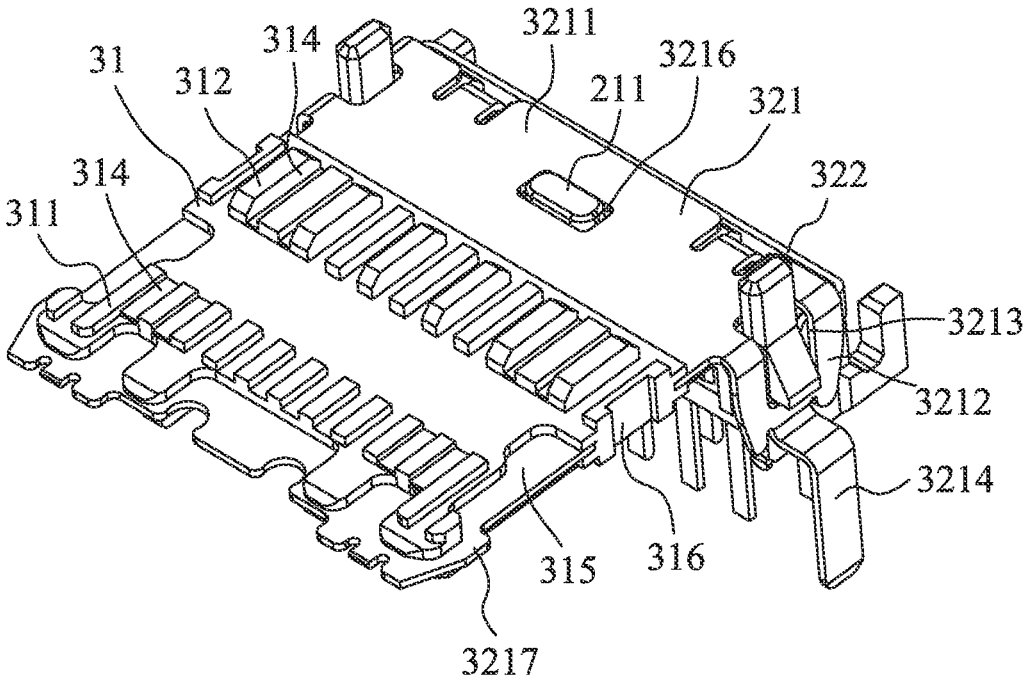
FIG. 7 is a perspective view showing that a tongue board assembly is assembled on the first terminal assembly of the receptacle connector of FIG. 3.
Figure 8:
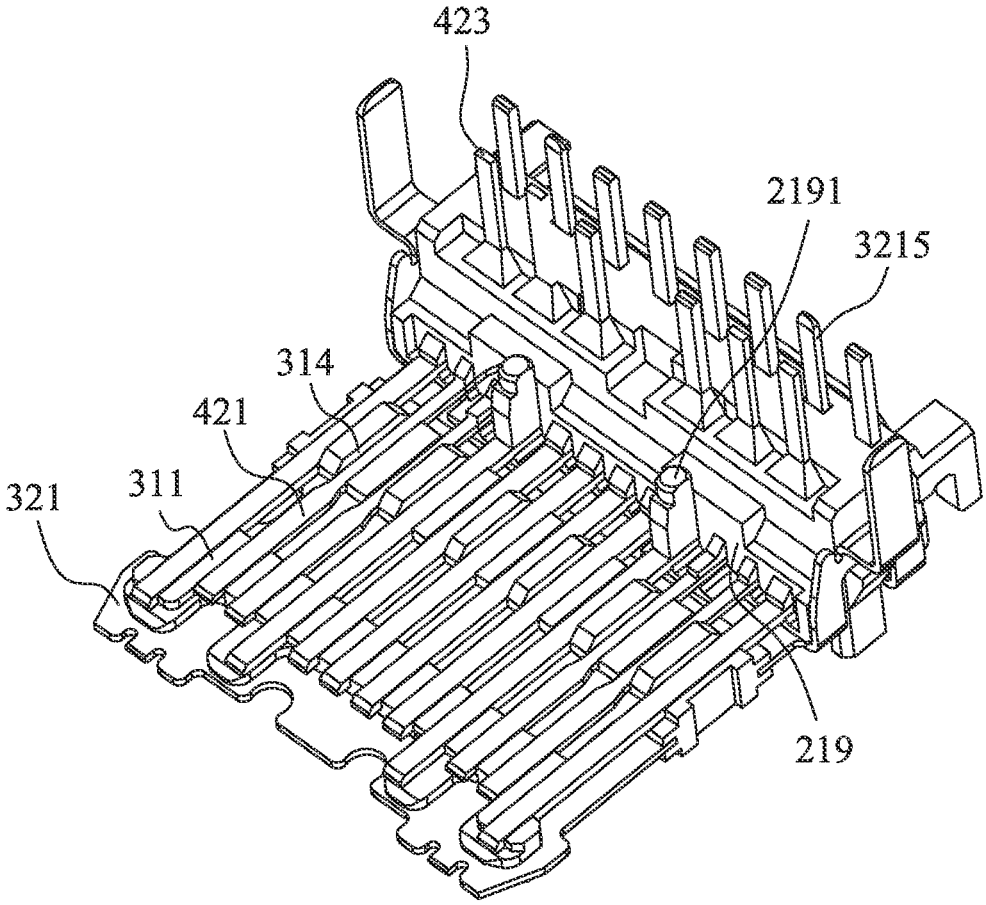
FIG. 8 is another perspective view of the assembly of FIG. 7.
Figure 9:
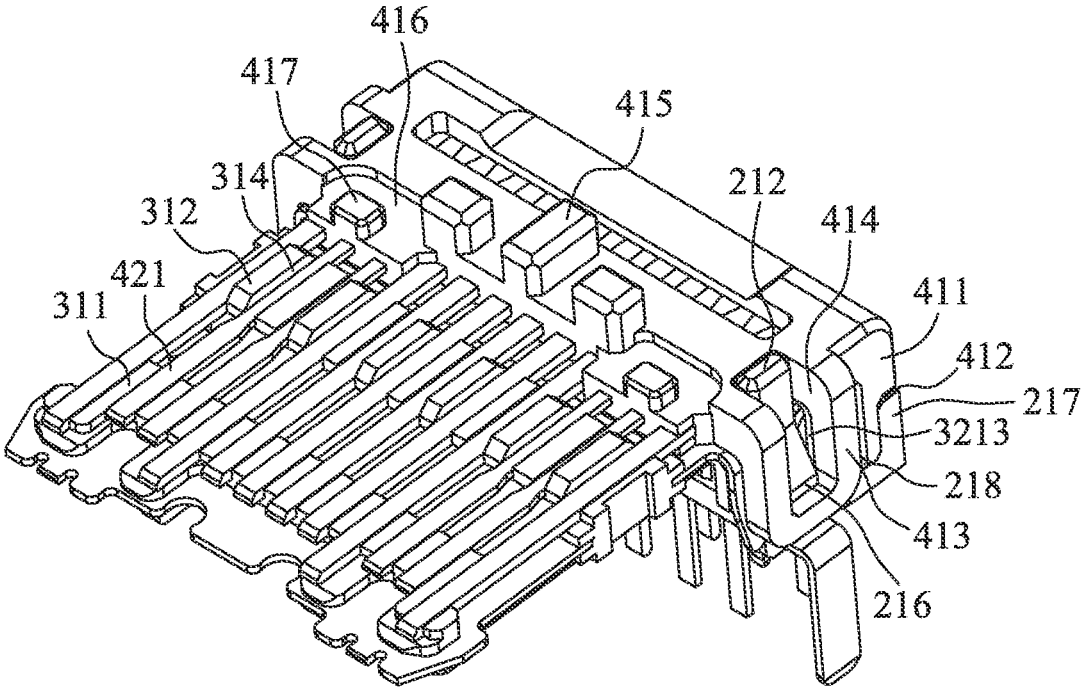
FIG. 9 is a perspective view showing that a second terminal assembly is assembled on the tongue board assembly and the first terminal assembly of the receptacle connector of FIG. 3.
Figure 10:
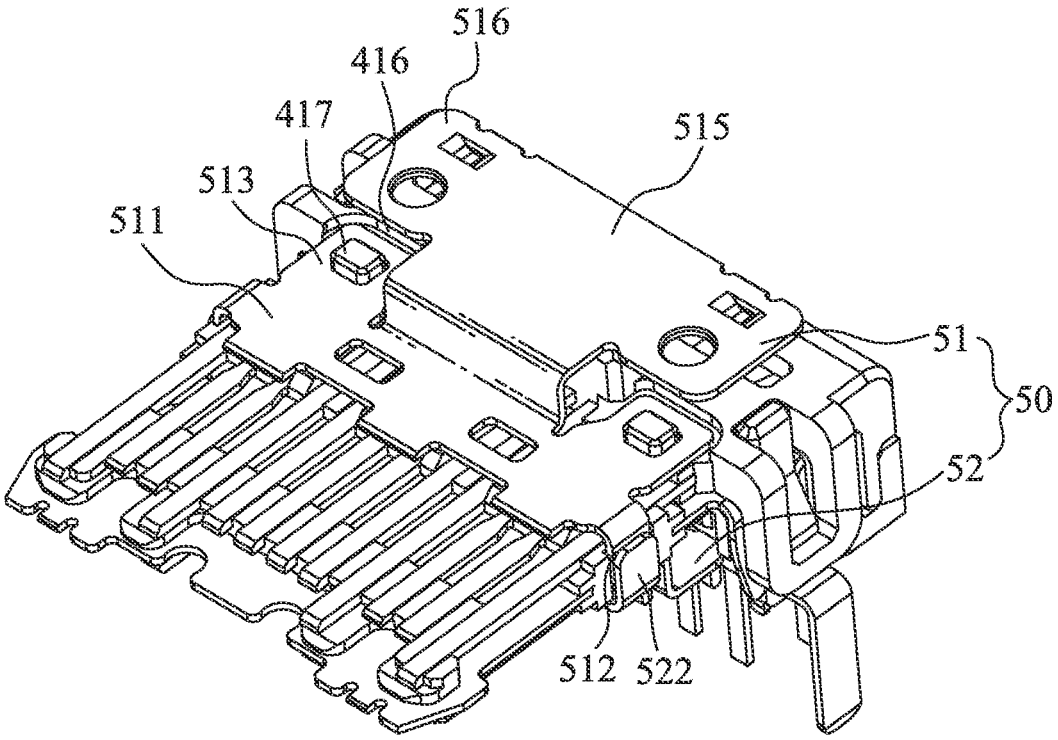
FIG. 10 is a perspective view showing that a shielding sheet assembly is assembled to the second terminal assembly, the tongue board assembly and the first terminal assembly of the receptacle connector of FIG. 3.
Figure 11:
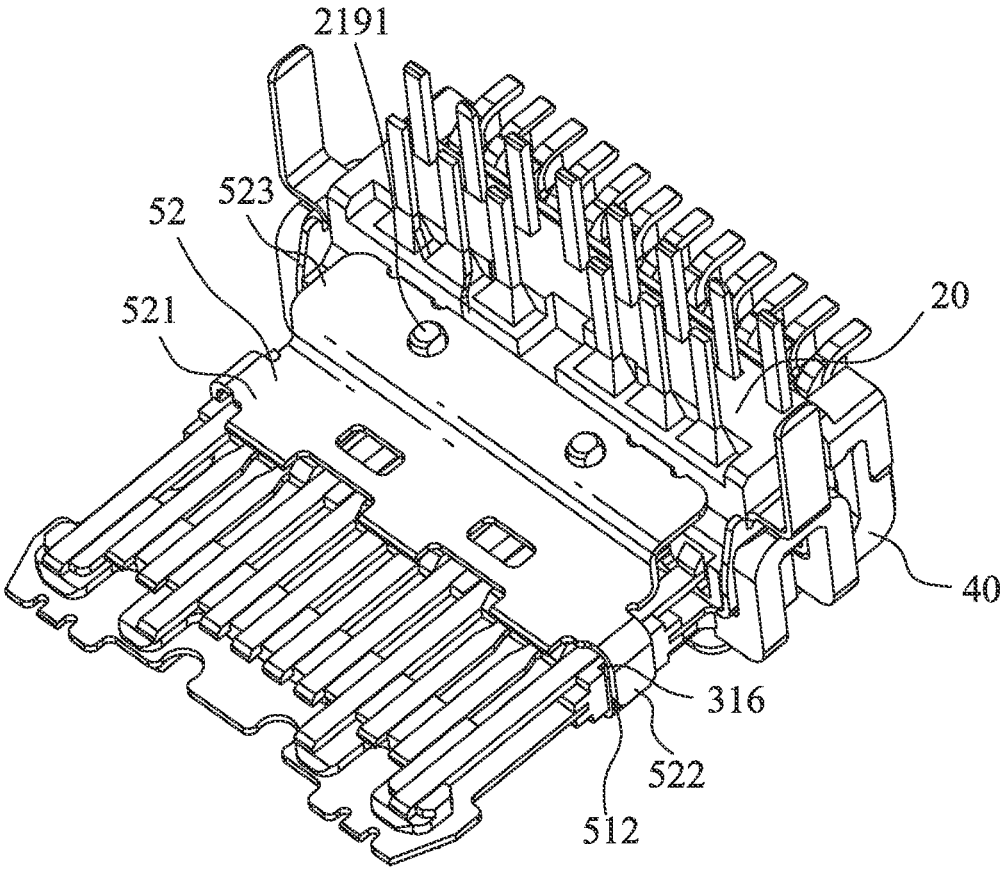
FIG. 11 is another perspective view of the assembly of FIG. 10.

Referring to the drawings in greater detail, and first to FIG. 1, FIG. 3 and FIG. 10, an embodiment of the present invention is embodied in a receptacle connector 100. The receptacle connector 100 includes an insulating housing 10, a first terminal assembly 20, a tongue board assembly 30, a second terminal assembly 40, a shielding sheet assembly 50 and a shielding shell 60.

Referring to FIGS. 1-13, the first terminal assembly 20 includes a first housing 21 and a plurality of first terminals 22 integrated with the first housing 21. The first terminals 22 are arranged in horizontal transverse direction in front of the first housing 21 and are arranged in vertical front and rear rows under the first housing 21.

The second terminal assembly 40 includes a second housing 41 and a plurality of second terminals 42 integrated with the second housing 41. A rear of a bottom face of the second housing 41 protrudes downward to form an extending portion 411. The second terminals 42 are arranged in horizontal transverse direction in front of the second housing 41 and are arranged in horizontal transverse direction under the extending portion 411. The second terminal assembly 40 is mounted downward onto the first terminal assembly 20, wherein the second housing 41 is fastened upon the first housing 21, the extending portion 411 is positioned in rear of the first housing 21, and the second terminals 42 are located over and behind the first terminals 22.

The tongue board assembly 30 is mounted between the first terminal assembly 20 and the second terminal assembly 40. The tongue board assembly 30 includes an insulating body 31 and a middle shielding sheet 32 integrated with the insulating body 31. A rear of the middle shielding sheet 32 is clamped between the first housing 21 and the second housing 41. The insulating body 31 is located in front of the first housing 21 and the second housing 41 to position the first terminals 22 and the second terminals 42 into a bottom face and a top face of the insulating body 31 respectively.

The insulating housing 10 has a base portion 11 molded outside the first housing 21, the rear of the middle shielding sheet 32 and the second housing 41. A front face of the base portion 11 protrudes frontward to form a tongue board 14 molded outside the insulating body 31 together with the first terminals 22 and the second terminals 42. Front ends of the first terminals 22 and the second terminals 42 are respectively exposed outside top and bottom faces of the tongue board 14. Tail ends of the first terminals 22 and the second terminals 42 project beyond a bottom face of the base portion 11.

The shielding sheet assembly 50 covers on the second terminal assembly 40 and under the first terminal assembly 20. The insulating housing 10 is further molded outside the shielding sheet assembly 50.

Referring to FIGS. 3-9, the first terminals 22 each has a first contact portion 221. A rear end of the first contact portion 221 extends downward to form a first soldering portion 222 perpendicular to the first contact portion 221. The rear end of the first contact portion 221 and a top end of the first soldering portion 222 are molded in the first housing 21. A front part of the first contact portion 221 projects in front of the first housing 21. A tail end of the first soldering portion 222 projects under the first housing 21. The top face and the bottom face of a front of the insulating body 31 protrude upward and downward respectively to form a plurality of third positioning lumps 311 arranged in transverse direction of the insulating body 31. The top face and the bottom face of a rear of the insulating body 31 protrude upward and downward respectively to form a plurality of fourth positioning lumps 312 arranged in transverse direction and corresponding to the third positioning lumps 311. Each two adjacent third positioning lumps 311 and two adjacent fourth positioning lumps 312 corresponding to the said third positioning lumps 311 of the bottom face of the insulating body 31 define a first terminal groove 313 therebetween. Each two adjacent third positioning lumps 311 and two adjacent fourth positioning lumps 312 corresponding to the said third positioning lumps 311 of the top face of the insulating body 31 define a second terminal groove 314 therebetween. The second terminals 42 each has a second contact portion 421. A rear end of the second contact portion 421 extends downward to form a fastening portion 422 perpendicular to the second contact portion 421. A bottom end of the fastening portion 422 is bent rearward to form a second soldering portion 423. The rear end of the second contact portion 421 of the second terminal 42 is molded in the second housing 41 and a front part of the second contact portion 421 of the second terminal 42 projects in front of the second housing 41. The fastening portion 422 is molded in the second housing 41 and the extending portion 411. The second soldering portion 423 of the second terminal 42 is located under the extending portion 411. The front parts of the first contact portions 221 of the first terminals 22 are held in the first terminal grooves 313. The front parts of the second contact portions 421 of the second terminals 42 are held in the second terminal grooves 314.

Two opposite ends of the extending portion 411 define a pair of buckling grooves 412. Two opposite sides of a rear face of the first housing 21 protrude rearward and then bend upward to form a pair of second buckling lumps 217. A receiving cavity 218 is defined between each second buckling lump 217 and the rear face of the first housing 21. Two opposite ends of a bottom of the extending portion 411 are buckled in the receiving cavities 218 and the second buckling lumps 217 are buckled in the buckling grooves 412 respectively.

A middle of a top face of the first housing 21 protrudes upward to form a first positioning lump 211. Two sides of the top face of the first housing 21 protrude upward to form a pair of second positioning lumps 212 higher than the first positioning lump 211. Two opposite laterals of the first housing 21 protrude outward to form a pair of first buckling lumps 216 under the second positioning lumps 212. The middle shielding sheet 32 includes a middle sheet 321 having a middle plate 3211. A rear of the middle plate 3211 projects behind the fourth positioning lumps 312 and covers the top face of the first housing 21. A substantial middle of the middle plate 3211 of the middle sheet 321 is opened with a first positioning hole 3216 for positioning the first positioning lump 211 of the first housing 21 therein. Two opposite sides of the rear of the middle plate 3211 are bent downward to form a pair of buckling plates 3212. Each of the buckling plates 3212 is opened with a first buckling hole 3213 through which the second positioning lump 212 and the corresponding first buckling lump 216 pass upward. The buckling plate 3212 is buckled under the first buckling lump 216. Two opposite sides of a front of the second housing 41 protrude outward and then extend downward to form a pair of buckling portions 413. Each of the buckling portions 413 is opened with a second buckling hole 414. The second housing 41 presses on the rear of the middle plate 3211. The second positioning lump 212 and the first buckling lump 216 are received in the second buckling hole 414. The second housing 41 is held between the second positioning lumps 212. The buckling portions 413 are against outsides of the buckling plates 3212 respectively and are buckled under the first buckling lumps 216.

A back face of the first housing 21 is concaved frontward to form at least one guiding slot 213 penetrating through the top face of the first housing 21. A bottom wall of each guiding slot 213 further defines a through hole 214 penetrating downward through the bottom face of the first housing 21. A bottom end of each of the buckling plates 3212 is bent outward and then extends downward to form a first inserting portion 3214. A rear end of the middle plate 3211 is bent downward and extends downward to from at least one second inserting portion 3215. The first inserting portions 3214 are molded in two sides of the base portion 11 of the insulating housing 10 with bottom ends thereof projecting downward beyond the bottom face of the base portion 11. The second inserting portions 3215 are received in the guiding slots 213 respectively and bottom ends thereof pass through the through holes 214 to project downward beyond the bottom face of the first housing 21.

Two opposite sides of a rear of the first housing 21 are concaved inward to form a pair of second fillisters 215. The middle shielding sheet 32 further includes a cover sheet 322 having a cover plate 3221. The cover plate 3221 is vertically clamped between the first housing 21 and the extending portion 411 of the second housing 41. Two opposite ends of the cover plate 322 are bent frontward and then extend downward to form a pair of third inserting portions 3222 which are respectively buckled in the second fillisters 215. The buckling plates 3212 of the middle sheet 321 are electrically against outsides of the third inserting portions 3222 respectively.

Referring to FIG. 3, FIG. 4 and FIGS. 7-13, a front face of a top of the first housing 21 protrudes frontward to form an installing lump 219 and a bottom face of the installing lump 219 protrudes downward to form a plurality of convex columns 2191. The front parts of the first contact portions 221 project in front of the installing lump 219 of the first housing 21. Two sides of a front of a top face of the second housing 41 are concaved downward to form a pair of installing grooves 416. A substantial middle of a bottom face of each installing groove 416 protrudes upward to form a fifth positioning lump 417. The shielding sheet assembly 50 includes an upper sheet 51 and a lower sheet 52. The upper sheet 51 has an upper plate 511. Two opposite sides of a rear end of the upper plate 511 protrude rearward to form a pair of first installing plates 513. Each first installing plate 513 is opened with a second positioning hole 514. A middle of the rear end of the upper plate 511 is bent upward and then extends rearward to form a first sub plate 515. Two opposite sides of the first sub plate 515 protrude outward to form a pair of second sub plates 516. The upper plate 511 of the upper sheet 51 covers on the fourth positioning lumps 312 of the insulating body 31 and is apart located over the second contact portions 421 of the second terminals 42. The first installing plates 513 are received in the installing grooves 416 respectively. The fifth positioning lumps 417 are buckled in the second positioning holes 514 respectively. A middle of the front of the top face of the second housing 41 protrudes upward to form at least one convex lump 415. The first sub plate 515 and the second sub plate 516 are located on the second housing 41 and the convex lump 415 resists against a bottom face of the first sub plate 515. The lower sheet 52 has a lower plate 521. A rear end of the lower plate 521 is bent downward and then extends rearward to form a second installing plate 523. The second installing plate 523 is opened with a plurality of third positioning holes 524. The lower plate 521 of the lower sheet 52 covers on the fourth positioning lumps 312 of the insulating body 31 and is apart located under the first contact portions 221 of the first terminals 22. The second installing plate 523 is located under the installing lump 219 and the convex columns 2191 are buckled in the third positioning holes 524 respectively. The upper sheet 51 and the lower sheet 52 are molded in the insulating housing 10. The upper plate 511 of the upper sheet 51 is exposed through a top face of a rear of the tongue board 14, and the first sub plate 515 and the second sub plate 516 are exposed through a top face of the base portion 11. The lower plate 521 of the lower sheet 52 is exposed through a bottom face of the rear of the tongue board 14. A rear end of the second installing plate 523 is embedded in the base portion 11.

Two opposite sides of a rear of the insulating body 31 are concaved inward to form a pair of fourth fillisters 316. Two opposite ends of the upper plate 511 are bent downward to form a pair of first fixing portions 512. Two opposite ends of the lower plate 521 are bent upward to form a pair of second fixing portions 522. The first fixing portions 512 are inserted in the fourth fillisters 316 respectively, and the second fixing portions 522 are against outsides of the corresponding first fixing portions 512 and soldered on the first fixing portions 512 respectively.

Referring to FIG. 1, FIG. 2, FIG. 3 and FIG. 13, the shielding shell 60 is worn around the insulating housing 10 and electrically connected to the shielding sheet assembly 50. The shielding shell 60 has a top plate 61, a bottom plate 62 and two side plates 63 together form an inserting chamber 64. The front face of the base portion 11 protrudes frontward to form a connecting portion 13 and a center of a front face of the connecting portion 13 further protrudes frontward to form the tongue board 14. The connecting portion 13 and the tongue board 14 are molded outside the insulating body 31 and received in the inserting chamber 64 of the shielding shell 60. A front end of the second installing plate 523 is exposed outside a bottom face of the connecting portion 13.

Referring to FIG. 3, FIG. 4, FIG. 7 and FIG. 12, two opposite sides of a front of the insulating body 31 are concaved inward to form a pair of third fillisters 315. Two opposite sides of the tongue board 14 are concaved inward to form a pair of first fillisters 15. Two opposite sides of a front end of the middle plate 3211 protrude outward to form a pair of butting plates 3217. A front part of the middle plate 3211 is horizontally embedded in the insulating body 31 with two opposite sides thereof projecting in the third fillisters 315. The two opposite sides of the front part of the middle plate 3211 and the butting plates 3217 are further molded in the first fillisters 15 of the tongue board 14 of the insulating housing 10.

Figure 12:
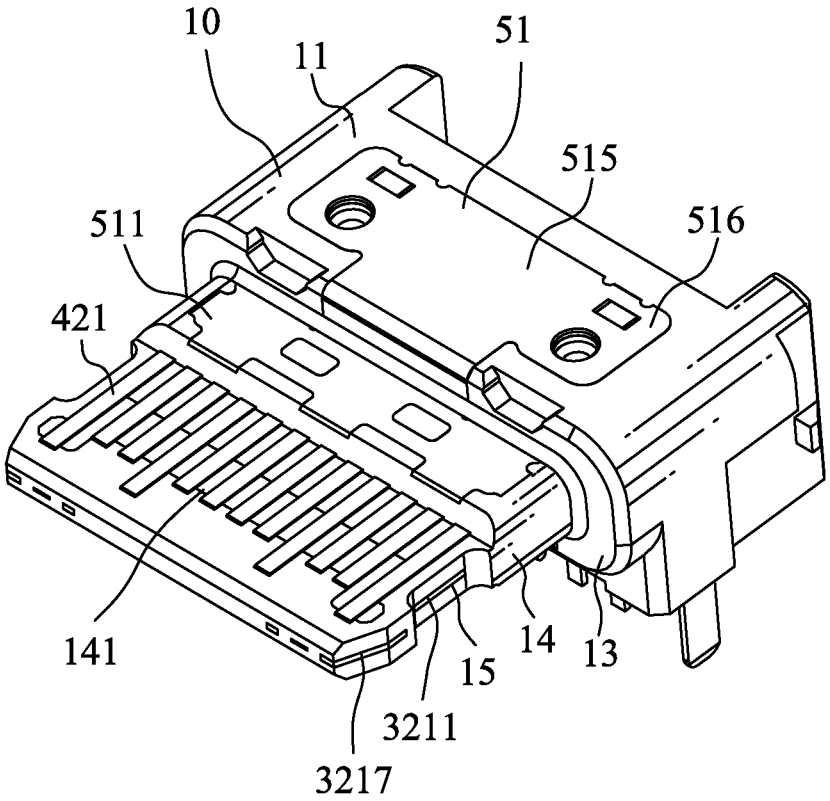
FIG. 12 is a perspective view of the receptacle connector without a shielding shell of the present invention.
Figure 13:
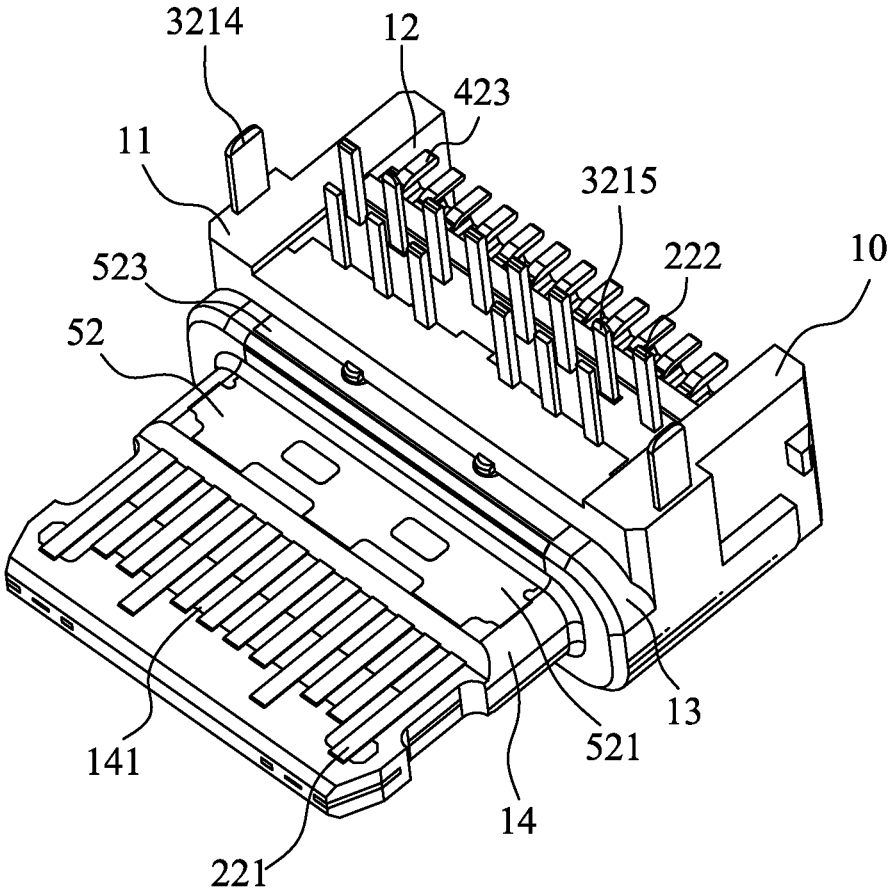
FIG. 13 is another perspective view of the receptacle connector without the shielding shell of FIG. 12.

Referring to FIG. 12 and FIG. 13, top and bottom faces of a front of the tongue board 14 define a pair of butting grooves 141. The front ends of the first terminals 22 and the second terminals 42 are exposed in the butting grooves 141 of the tongue board 14.

Referring to FIGS. 2-4 and FIG. 13, a center of a rear face of the base portion 11 is concaved frontward to form an opening 12 vertically penetrating through the base portion 11. The second soldering portions 423 of the second terminals 42 are located in the opening 12.

As described above, the first terminal assembly 20, the second terminal assembly 40, the tongue board assembly 30 and the insulating housing 10 are molded together to form the receptacle connector 100, wherein the tongue board 14 together with the front ends of the first terminals 22 and the second terminals 42 of the receptacle connector 100 are symmetrical about a horizontal center plane of the tongue board 14. Therefore, users don't need to recognize positive and negative directions of the receptacle connector 100 specially when using the receptacle connector 100. It is convenience for use and the structure is stable, even it improves the effect of the signal transmission.

What is claimed is:

1. A receptacle connector, comprising:

a first terminal assembly including a first housing and a plurality of first terminals integrated with the first housing, the first terminals being arranged in horizontal transverse direction in front of the first housing and being arranged in vertical front and rear rows under the first housing;

a second terminal assembly including a second housing and a plurality of second terminals integrated with the second housing, a rear of a bottom face of the second housing protruding downward to form an extending portion, the second terminals being arranged in horizontal transverse direction in front of the second housing and being arranged in horizontal transverse direction under the extending portion, the second terminal assembly being mounted downward onto the first terminal assembly, wherein the second housing is fastened upon the first housing, the extending portion is positioned in rear of the first housing, the second terminals are located over and behind the first terminals;

a tongue board assembly mounted between the first terminal assembly and the second terminal assembly, the tongue board assembly including an insulating body and a middle shielding sheet integrated with the insulating body, a rear of the middle shielding sheet being clamped between the first housing and the second housing, the insulating body being located in front of the first housing and the second housing to position the first terminals and the second terminals into a bottom face and a top face of the insulating body respectively;

an insulating housing having a base portion molded outside the first housing, the rear of the middle shielding sheet and the second housing, a front face of the base portion protruding frontward to form a tongue board molded outside the insulating body together with the first terminals and the second terminals, front ends of the first terminals and the second terminals being respectively exposed outside top and bottom faces of the tongue board, tail ends of the first terminals and the second terminals projecting beyond a bottom face of the base portion;

a shielding shell worn around the insulating housing; and a shielding sheet assembly covering on the second terminal assembly and under the first terminal assembly, the insulating housing being further molded outside the shielding sheet assembly;

wherein the first terminals each has a first contact portion, a rear end of the first contact portion extends downward to form a first soldering portion perpendicular to the first contact portion, the rear end of the first contact portion and a top end of the first soldering portion are molded in the first housing, a front part of the first contact portion projects in front of the first housing, a tail end of the first soldering portion projects under the first housing, the top face and the bottom face of a front of the insulating body protrude upward and downward respectively to form a plurality of third positioning lumps arranged in transverse direction of the insulating body, the top face and the bottom face of a rear of the insulating body protrude upward and downward respectively to form a plurality of fourth positioning lumps arranged in transverse direction and corresponding to the third positioning lumps, each two adjacent third positioning lumps and two adjacent fourth positioning lumps corresponding to the said third positioning lumps of the bottom face of the insulating body define a first terminal groove therebetween, each two adjacent third positioning lumps and two adjacent fourth positioning lumps corresponding to the said third positioning lumps of the top face of the insulating body define a second terminal groove therebetween, the second terminals each has a second contact portion, a rear end of the second contact portion extends downward to form a fastening portion perpendicular to the second contact portion, a bottom end of the fastening portion is bent rearward to form a second soldering portion, the rear end of the second contact portion of the second terminal is molded in the second housing and a front part of the second contact portion of the second terminal projects in front of the second housing, the fastening portion is molded in the second housing and the extending portion, the second soldering portion of the second terminal is located under the extending portion, the front parts of the first contact portions of the first terminals are held in the first terminal grooves, the front parts of the second contact portions of the second terminals are held in the second terminal grooves;

wherein two sides of a top face of the first housing protrude upward to form a pair of second positioning lumps, two opposite laterals of the first housing protrude outward to form a pair of first buckling lumps under the second positioning lumps, the middle shielding sheet includes a middle sheet having a middle plate, a rear of the middle plate projects behind the fourth positioning lumps and covers the top face of the first housing, two opposite sides of the rear of the middle plate are bent downward to form a pair of buckling plates, each of the buckling plates is opened with a first buckling hole through which the second positioning lump and the corresponding first buckling lump pass upward, the buckling plate is buckled under the first buckling lump, two opposite sides of a front of the second housing protrude outward and then extend downward to form a pair of buckling portions, each of the buckling portions is opened with a second buckling hole, the second housing presses on the rear of the middle plate, the second positioning lump and the first buckling lump are received in the second buckling hole, the second housing is held between the second positioning lumps, the buckling portions are against outsides of the buckling plates respectively and are buckled under the first buckling lumps.

2. The receptacle connector as claimed in claim 1, wherein two opposite ends of the extending portion define a pair of buckling grooves, two opposite sides of a rear face of the first housing protrude rearward and then bend upward to form a pair of second buckling lumps, a receiving cavity is defined between each second buckling lump and the rear face of the first housing, two opposite ends of a bottom of the extending portion are buckled in the receiving cavities and the second buckling lumps are buckled in the buckling grooves respectively.

3. The receptacle connector as claimed in claim 1, wherein a back face of the first housing is concaved frontward to form at least one guiding slot penetrating through the top face of the first housing, a bottom wall of each guiding slot further defines a through hole penetrating downward through the bottom face of the first housing, a bottom end of each of the buckling plates is bent outward and then extends downward to form a first inserting portion, a rear end of the middle plate is bent downward and extends downward to from at least one second inserting portion, the first inserting portions are molded in two sides of the base portion of the insulating housing with bottom ends thereof projecting downward beyond the bottom face of the base portion, the second inserting portions are received in the guiding slots respectively and bottom ends thereof pass through the through holes to project downward beyond the bottom face of the first housing.

4. The receptacle connector as claimed in claim 1, wherein two opposite sides of a rear of the first housing are concaved inward to form a pair of second fillisters, the middle shielding sheet further includes a cover sheet having a cover plate, the cover plate is vertically clamped between the first housing and the extending portion of the second housing, two opposite ends of the cover plate are bent frontward and then extend downward to form a pair of third inserting portions which are respectively buckled in the second fillisters, the buckling plates of the middle sheet are electrically against outsides of the third inserting portions respectively.

5. The receptacle connector as claimed in claim 1, wherein a front face of a top of the first housing protrudes frontward to form an installing lump and a bottom face of the installing lump protrudes downward to form a plurality of convex columns, the front parts of the first contact portions project in front of the installing lump of the first housing, two sides of a front of a top face of the second housing are concaved downward to form a pair of installing grooves, a substantial middle of a bottom face of each installing groove protrudes upward to form a fifth positioning lump, the shielding sheet assembly includes an upper sheet and a lower sheet, the upper sheet has an upper plate, two opposite sides of a rear end of the upper plate protrude rearward to form a pair of first installing plates, each first installing plate is opened with a second positioning hole, a middle of the rear end of the upper plate is bent upward and then extends rearward to form a first sub plate, the upper plate of the upper sheet covers on the fourth positioning lumps of the insulating body and is apart located over the second contact portions of the second terminals, the first installing plates are received in the installing grooves respectively, the fifth positioning lumps are buckled in the second positioning holes respectively, a middle of the front of the top face of the second housing protrudes upward to form at least one convex lump, the first sub plate is located on the second housing and the convex lump resists against a bottom face of the first sub plate, the lower sheet has a lower plate, a rear end of the lower plate is bent downward and then extends rearward to form a second installing plate, the second installing plate is opened with a plurality of third positioning holes, the lower plate of the lower sheet covers on the fourth positioning lumps of the insulating body and is apart located under the first contact portions of the first terminals, the second installing plate is located under the installing lump and the convex columns are buckled in the third positioning holes respectively, the upper sheet and the lower sheet are molded in the insulating housing, the upper plate and the first sub plate of the upper sheet are exposed through top faces of a rear of the tongue board and the base portion, the lower plate of the lower sheet is exposed through a bottom face of the rear of the tongue board, a rear end of the second installing plate is embedded in the base portion.

6. The receptacle connector as claimed in claim 5, wherein two opposite sides of a rear of the insulating body are concaved inward to form a pair of fourth fillisters, two opposite ends of the upper plate are bent downward to form a pair of first fixing portions, two opposite ends of the lower plate are bent upward to form a pair of second fixing portions, the first fixing portions are inserted in the fourth fillisters respectively, the second fixing portions are against outsides of the corresponding first fixing portions and soldered on the first fixing portions respectively.

7. The receptacle connector as claimed in claim 5, wherein the shielding shell has a top plate, a bottom plate and two side plates together form an inserting chamber, the front face of the base portion protrudes frontward to form a connecting portion and a center of a front face of the connecting portion further protrudes frontward to form the tongue board, the connecting portion and the tongue board are molded outside the insulating body and received in the inserting chamber of the shielding shell, a front end of the second installing plate is exposed outside a bottom face of the connecting portion.

8. The receptacle connector as claimed in claim 7, wherein two opposite sides of a front of the insulating body are concaved inward to form a pair of third fillisters, two opposite sides of the tongue board are concaved inward to form a pair of first fillisters, two opposite sides of a front end of the middle plate protrude outward to form a pair of butting plates, a front part of the middle plate is horizontally embedded in the insulating body with two opposite sides thereof projecting in the third fillisters, the two opposite sides of the front part of the middle plate and the butting plates are further molded in the first fillisters of the tongue board of the insulating housing.

9. The receptacle connector as claimed in claim 1, wherein a center of a rear face of the base portion is concaved frontward to form an opening vertically penetrating through the base portion, the second soldering portions of the second terminals are located in the opening.

10. The receptacle connector as claimed in claim 1, wherein top and bottom faces of a front of the tongue board define a pair of butting grooves, the front ends of the first terminals and the second terminals are exposed in the butting grooves of the tongue board.

* * * * *